US007708706B2

(12) United States Patent
Swidler

(10) Patent No.: US 7,708,706 B2
(45) **Date of Patent: *May 4, 2010**

(54) IMPACT TABLE WITH ROTATABLE LIFT DISK AND SHOCK ABSORBER

(75) Inventor: Steven A. Swidler, Tucson, AZ (US)

(73) Assignee: The Table Project, LLC, Tucson, AZ (US)

( * ) Notice: Subject to any disclaimer, the term of this patent is extended or adjusted under 35 U.S.C. 154(b) by 989 days.

This patent is subject to a terminal disclaimer.

(21) Appl. No.: 10/159,739

(22) Filed: May 31, 2002

(65) Prior Publication Data

US 2004/0210173 A1 Oct. 21, 2004

(51) Int. Cl.
*A61H 1/00* (2006.01)

(52) U.S. Cl. ..... 601/26; 601/108; 601/98; 601/101; 606/240

(58) Field of Classification Search ..... 601/24, 601/26, 49, 51, 46, 98, 100, 101, 107, 108, 601/18, 23; 606/240
See application file for complete search history.

(56) References Cited

U.S. PATENT DOCUMENTS 4,220,143 A * 9/1980 Cummins et al. ..... 601/90
4,483,327 A * 11/1984 Graham et al. ..... 601/26
4,570,927 A * 2/1986 Petrofsky et al. ..... 482/60
4,858,599 A * 8/1989 Halpern ..... 601/105
4,958,627 A * 9/1990 Park ..... 601/49
4,969,451 A * 11/1990 Totten ..... 601/53
4,979,501 A * 12/1990 Valchanov et al. ..... 601/2
4,999,861 A * 3/1991 Huang ..... 5/600
5,626,555 A * 5/1997 Di Blasi et al. ..... 601/98

* cited by examiner

*Primary Examiner*—Danton DeMille
(74) *Attorney, Agent, or Firm*—Leydig, Voit & Mayer, Ltd.

(57) ABSTRACT

The invention is a synchronous impact table (the impact table). The impact table includes a support system having a control system therein, a power system coupled to the control system, a lift system coupled to the power system and the support system, and a patient support system coupled to the lift system. By providing a synchronous percussion wave to a user continuously over time, body and jaw alignment can be enhanced, soft connective tissue can return to its natural position, and body fluids can again flow and balance more naturally.

18 Claims, 7 Drawing Sheets

IMPACT TABLE WITH ROTATABLE LIFT DISK AND SHOCK ABSORBER

TECHNICAL FIELD

Generally, the invention relates healthcare facilities such as spas, wellness centers, rehabilitation, and chiropractic centers. More particularly, the invention relates to devices that balance body connective tissue function, and restore body fluid balance and motion.

STATEMENT OF A PROBLEM ADDRESSED BY THIS INVENTION

Many persons experience soft tissue strains due to minor or severe trauma, such as falls, an auto accident. Many other people experience injuries due to repetitive traumas that are practically unnoticeable from day-to-day, but have a cumulative effect that results in physical pain and discomfort.

Injuries can displace, shorten or twist connective tissue, which can decrease range of motion and/or function, decrease blood flow or lymphatic drainage. These areas are then not functioning as optimally as possible. Normal body function (such as the removal of toxins) by the lymph system or the normal blood flow can be inhibited by these restrictions. On a more conscious level, a patient may feel discomfort or restriction, sometimes at the point of displacement, and sometimes in seemingly unrelated locations. For example, a pull in the chest may not only result in chest pain, but also in back pain, neck pain, or headaches.

Some devices for relaxing or "unwinding" connective tissue include chiropractic manipulation devices, massage devices, and hand held percussors. However, these and others tend to act locally rather then affect the whole body to "unwind and reset" the whole "body glove" of reciprocating connective tissue. Therefore, what is needed is a device that relaxes and unwinds soft tissue injury and strain patterns, which invites balanced alignment, and balances fluid motion globally (in the entire body) to bring about stabilizing changes in body alignment and soft-tissue position.

With more than forty percent of the body's neurologic innervations being in the head, this has numerous implications for a person whose jaw is out of alignment. Thus, one common malalignment of jaw/bite relationships is TMJ (Tempero Mandibular Joint) dysfunction. Jaw malalignment can be complicated or affected by other jaw-related problems including neckaches, shoulder, or even a high hip position that can sometimes be traced to an out-of-alignment jaw. Accordingly, it would also be advantageous to provide a device that promotes balanced body/jaw alignment before dental stabilization.

SELECTED OVERVIEW OF SELECTED EMBODIMENTS

The invention achieves technical advantages as a synchronous impact table (the impact table). The impact table includes a support system having a control system therein, a power system coupled to the control system, a lift system coupled to the power system and the support system, and a patient support system coupled to the lift system. Various embodiments of the invention may incorporate specific embodiments of the aforementioned systems to more effectively achieve desired results. Thus, the invention provides a means by which a controlled impact (or "shock") wave can be delivered to a user. By providing a synchronous impact wave to a user continuously over a specific time, strained or twisted soft connective tissue can return to its natural unrestricted position, and body fluids can again flow more naturally.

Of course, other features and embodiments of the invention will be apparent to those of ordinary skill in the art. After reading the specification, and the detailed description of the exemplary embodiment, these persons will recognize that similar results can be achieved in not dissimilar ways. Accordingly, the detailed description is provided as an example of the best mode of the invention, and it should be understood that the invention is not limited by the detailed description. Accordingly, the invention should be read as being limited only by the claims.

BRIEF DESCRIPTION OF THE DRAWINGS

Various aspects of the invention, as well as an embodiment, are better understood by reference to the following EXEMPLARY EMBODIMENT OF A BEST MODE. To better understand the invention, the EXEMPLARY EMBODIMENT OF A BEST MODE should be read in conjunction with the drawings in which.

AN EXEMPLARY EMBODIMENT OF A BEST MODE

Figure 1:
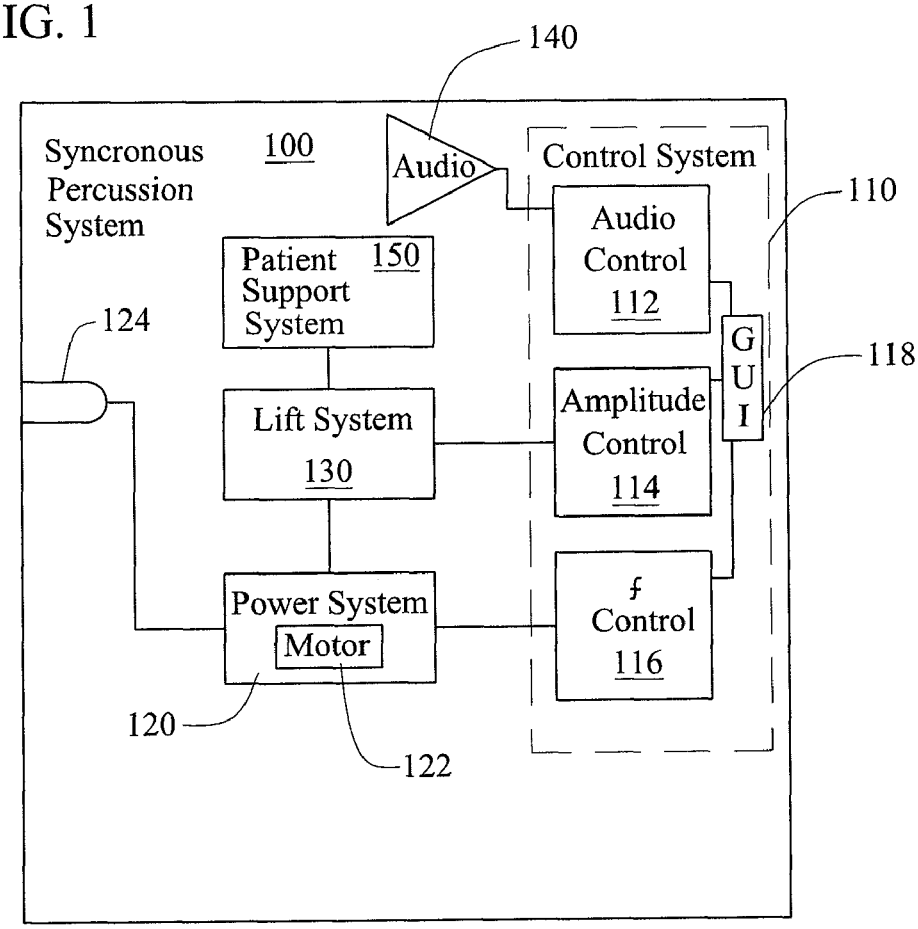
FIG. 1 shows a synchronous impact system.

The invention is a synchronous impact table (the impact table). The impact table includes a support system having a control system therein, a power system coupled to the control system, a lift system coupled to the power system and the support system, and a patient support system coupled to the lift system. By providing a synchronous percussion wave (impact wave) to a user continuously over a period of time, body alignment can be facilitated as strained or displaced soft connective tissue can return to its natural position, allowing body fluids to again flow more naturally free of soft tissue restrictions. Preferably, the impact table creates an impact wave that acts globally on a body with a wave that is adjustable in both frequency and amplitude.

Interpretation Considerations

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching"). Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section.

DESCRIPTION OF THE DRAWINGS

Better understanding of the invention can be gained by examining a system as taught by the invention. FIG. 1 shows a synchronous impact system (the percussion system 100). The impact system 100 includes systems needed to control the creation and delivery of an impact wave. Thus, the impact system 100 typically includes a control system 110 that controls the other systems of the impact system 100. In addition, a power system 120 coupled to the control system 110. The power system 120 receives electrical power (typically from an external power source) and then converts the electrical power into mechanical power that is delivered to a lift system 130. Accordingly, the power system 120 may comprise or be coupled to a power source receptacle 124, such that the power source receptacle 124 may receive power from an external power source. The lift system 130 includes the mechanical elements needed to lift and then drop a patient support system 150. Accordingly, the impact wave is generated and delivered to a user via the lift system 130.

The control system 110 includes units that are selected for controlling the specific functions of various embodiments of the invention, and, in one embodiment the control system 110 includes a graphical user interface (GUI) 118. For example, the control system 110 typically includes an amplitude control 114, and a frequency control 116. In a preferred embodiment, the control system also includes an audio control 112.

The frequency control 116 is preferably coupled to the power system 120. Then, by controlling voltage, current, or frequency of a power source to the power system, or by regulating a element in the power system 120, the frequency and amplitude controls control the frequency and/or strength of a impact wave. The amplitude control 114 is typically coupled to the lift system 130 so that by controlling the spacing of the lift system relative to the patient support system 150, the amplitude of the impact wave can be controlled. Thus, it should be recognized that the amplitude control 114 can alternatively be connected to the patient support system 150 as well as the lift system 130.

In one alternative embodiment, the impact system 100 employs audio waves to supplement or harmonize the effects of an impact wave. When this is done, the audio control 112 is coupled to an audio system 140. Thus, in practice, an audio wave of a desired frequency and amplitude can be provided to a user of the impact system 100. Similarly other frequencies, preferably harmonics) may be utilized to augment or broaden the desired affects.

The lift system 130 comprises the elements needed to control the spacing between a lifter, such as a lift disk, and an impact table maintained in the patient support system 150. In one embodiment, the lift system comprises a plurality of lift disks (or cams) that are driven by a motor 122 in the power system 120. Each lift disks raises and lowers a lift-receiver (or push rod) that is affixed to the impact table, and thus each lift disk is set (or positioned) to simultaneously raise and lower the patient support system 150. Accordingly, the shape of a lift disk can influence the frequency and amplitude of the percussion wave, and, in an alternative embodiment, the frequency and amplitude can be controlled by replacing lift disks. Thus, in this embodiment, the lift disks comprise a control system.

Exemplary Methods

The invention, in one embodiment, applies an impact wave to a user to effect changes in body alignment to reduce soft-tissue strain patterns, and to balance body fluids. The impact wave offers many advantages over traditional equipment since the impact wave is actually a plurality of waves that are transposed upon each other, and that are practically simultaneously created when an impact shock is applied throughout a surface. In practice, a recipient of an impact wave will experience healing and body adjustment since their body naturally acts as a wave receiver, receiving needed frequencies from the plurality of frequencies comprising the impact wave, while passing unneeded frequencies.

Figure 2:
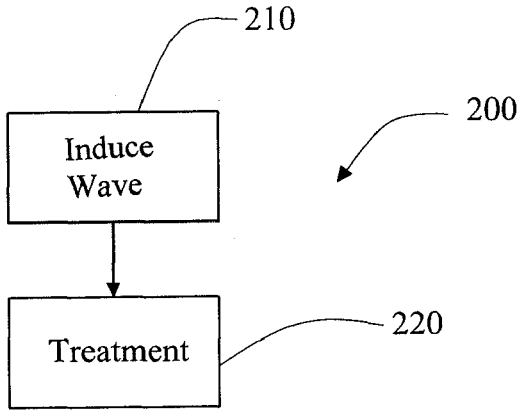
FIG. 2 illustrates an impact wave method.

Accordingly, FIG. 2 illustrates an impact wave method 200. The impact wave method begins with a induce wave act 210. In the induce wave act 210 an impact wave is created, and is preferably created by a synchronous impact system.

Next, the impact wave method 200 proceeds to a treatment act 220. In the treatment act 220 the impact wave is used to relax soft tissue strain patters to promote a user's improved alignment, soft tissue, or body fluid issues. Of course, the invention may be practiced in more detail. For example, one may explore the use of an impact table to deliver an impact wave.

Figure 3:
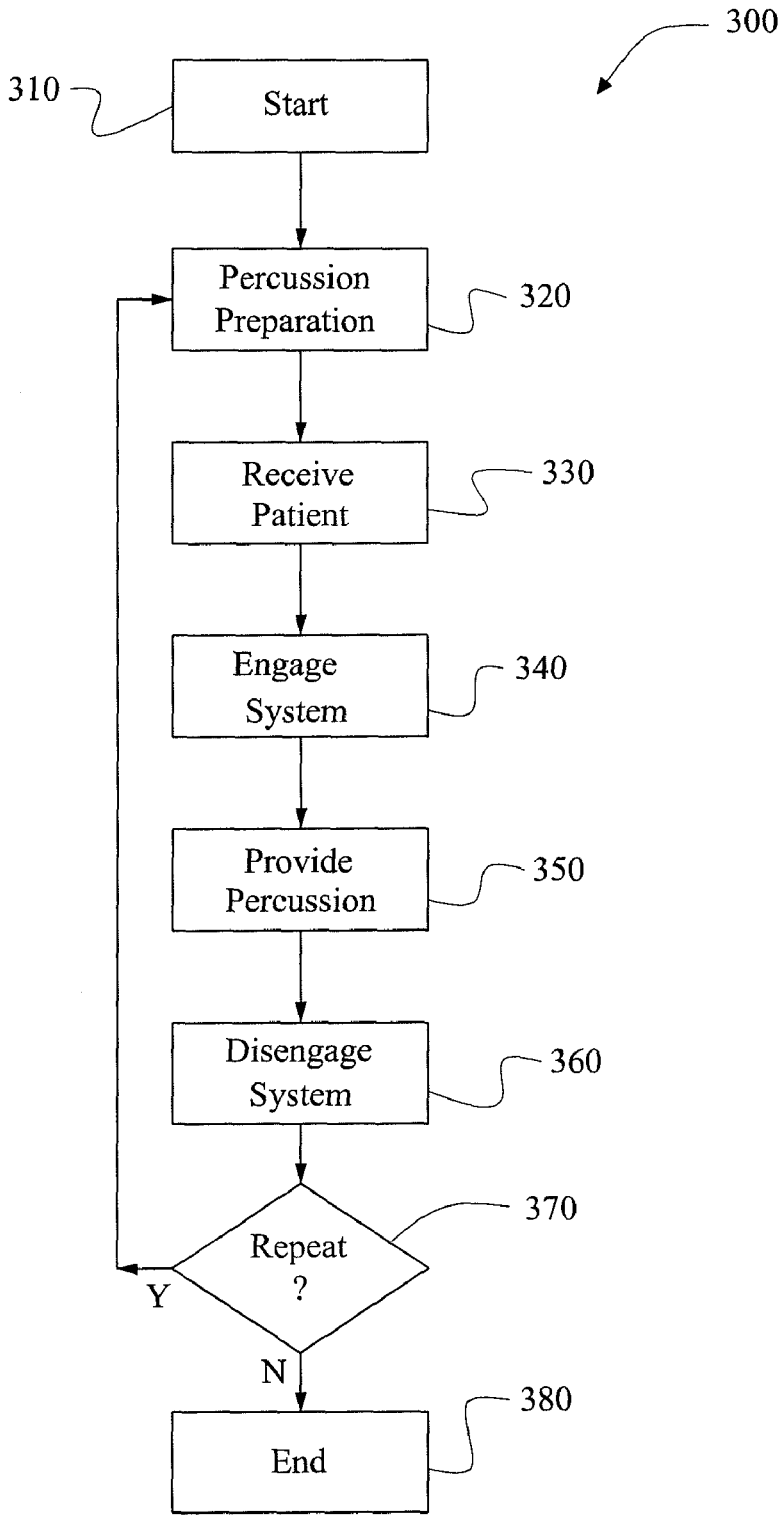
FIG. 3 teaches an impact table method.

Accordingly, FIG. 3 teaches an impact table method 300 for providing a shock wave (impact wave) to a user. In the impact table method 300 a single impact wave is induced on an impact table. Preferably, the impact wave is induced across an area approximately the size of a person via a synchronous impact delivery system.

The impact table method 300 begins with a start act 310. In the start act 310 the table is powered-up, and any systems that require initialization are initialized. Next, in an impact preparation act 320 a trained person sets a chosen frequency, amplitude, and acoustic frequency and amplitude, thus providing a pre-selected frequency and amplitude for a user/client/patient. It should be Unto understood that while a constant frequency and amplitude are implied by the present discussion, it is obvious to one of ordinary skill in the art to adjust lift disks for amplitude or frequency, or to set a program that adjusts the frequency or amplitude of either or both of the impact wave as well as the audio. Furthermore, it is also considered obvious to provide more than one audio wave (or, sound wave) at a time if utilized, as audio frequencies and amplitudes can be superimposed upon each other. In a preferred embodiment, the percussion wave has a frequency of between 1 Hz and 100 Hz, and preferably 4 Hz to 15 Hz. Similarly, there are preferred amplitudes of ⅛ inch in height to micrometers that may barely be perceived by a user as a "hum" of a vibration.

Following the preparation of the impact system (and particularly the control system) in the impact preparation act 320, the impact table method 300 proceeds to receive patient act 330. In the receive patient act 330 the impact table receives a user who lies on the impact table. The user may lie on the back, on the belly, or lie in another manner that directly involves an affected (injured or traumatized) area for treatment. Of course, the user may assume other positions as are needed to most effectively treat the user as a whole or for a specific injury. Then, in an engage system act 340, the impact table begins providing an impact wave to the user.

Impact waves are then provided to a user for a pre-selected period of time in a provide percussion act 350. For example, when "testing" a user's tolerance for the impact waves, the impact table may operate for only a few seconds, such as 20 seconds. However, for treatment, more extended periods of exposure to the impact waves are preferred, such as between five minutes and thirty minutes of impact wave exposure. Preferably, a user is exposed to the impact waves for twenty to twenty five minutes. It is also preferable to set the time a user is exposed to the impact waves based on the user's injury/trauma, and the user's tolerance for the impact waves. The impact waves are then ended by disengaging the synchronous impact system in a disengage system act 360, at which time the audio waves, if utilized, may also be discontinued.

Following the disengagement of the synchronous impact system, the impact table method 300 proceeds to a repeat query 370. If in the repeat query it is determined or preselected that the impact table method is to repeat, the impact table method returns to the start act 310 as shown by the "y" decision loop. However, if in the repeat query 370 it is determined or preselected that the user no longer presently needs exposure to further impact waves, then the impact table method 300 proceeds to an end act 380 as illustrated by the "n" decision. In the end act 380, the user disembarks the impact table, and, if the impact table is not to receive further users presently, then the impact table powers-down.

Preferred Impact Embodiments

Figure 4:
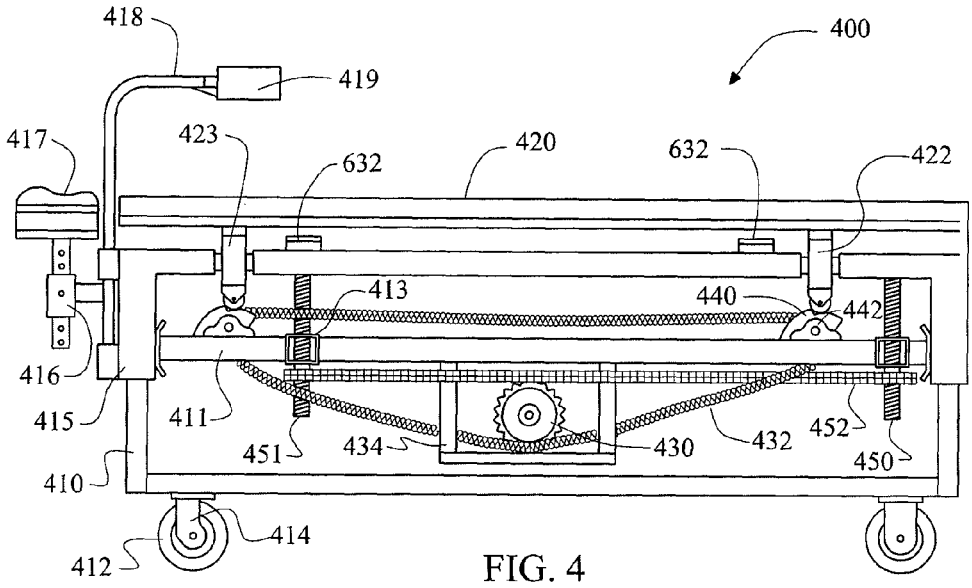
FIG. 4 is a side view of one embodiment of an impact table.
Figure 5A:
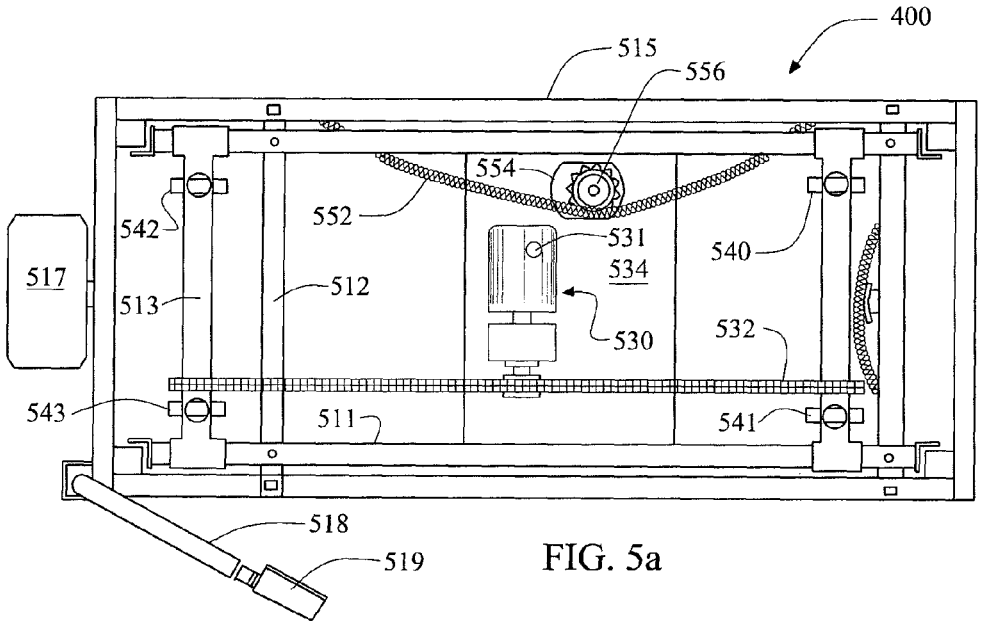
FIG. 5*a* provides a top view of selected elements of the impact table shown in FIG. 4.
Figure 5B:
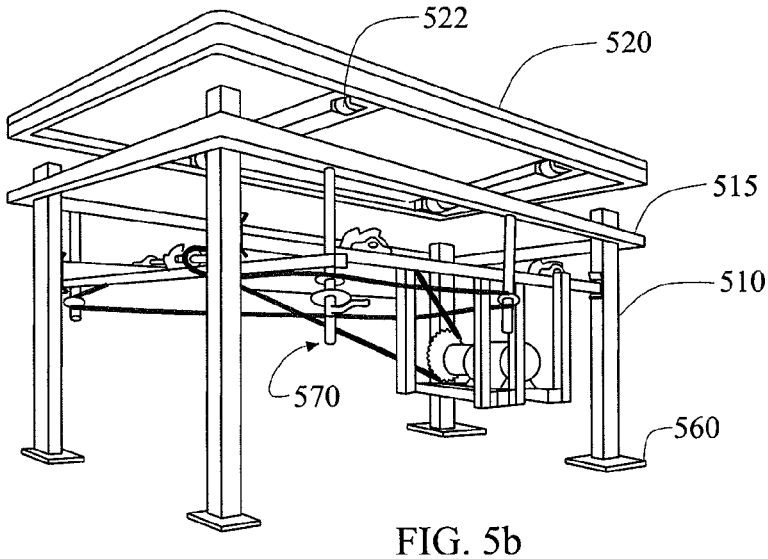
FIG. 5*b* illustrates an elevated side-view of an alternative embodiment of the invention.

To implement the invention, one may wish to use a selected preferred embodiment. FIG. 4 is a side view of a preferred embodiment of a synchronous impact table (the impact table 400). FIG. 5*b* provides a top view of selected elements of the alternative embodiment of the impact table 400, and when appropriate, is also referenced herein. In the Figures, the first digit of a number corresponds to the figure in which it resides. Accordingly, items numbered 400-499 reside in FIG. 4, while items numbered 500-599 reside in FIG. 5.

The impact table 400 provides a support system embodied as a frame 410 and an active frame 415, a control system comprising a motor dial (motor speed adjustment mechanism) 531 and a height adjustor 556, a power system that includes a motor 430, 530 coupled to the control system, a lift system coupled to the power system and the support system, and a patient support system embodied as a patient support system table 420 coupled to the lift system.

The frame 410 provides a platform for the invention, and, although preferable, is not necessary for implementing an impact wave. The impact table may sit upon four wheels 412 coupled to the frame 410 via wheel mounts 414 that are rigidly fixed to the frame 410. The frame 410 also provides support for the active frame 415, 515 which supports the majority of the impact table's functional items.

For example, an optional headrest 417, 418 is coupled to the active frame 415, 515 via a headrest height adjustor 416 such as the pin-and-notch height adjustor shown in FIG. 4, which is in turn adjustably fixed to the active frame 415, 515. Accordingly, some patients will benefit from having their head remain still while an impact wave is induced through their body. Similarly, an overhead light 419, 519 is adjustably coupled to the active frame 415, 515 via a swivel arm 418, 518. This allows a practitioner to cast light upon a treated area of the user.

The active frame 415, 515 preferably has an internal frame 411, 511, 512, 513 (hereinafter 411). The internal frame 411 provides the direct support and connections for the systems of the impact table. For example, a screw 450 is threaded through a threaded screw-hole 413 (which together comprises a mechanically adjustable screw mechanism). Similarly, a power system support 434, 534 is mounted to the internal frame 411 via screws, welding, or other rigid coupling means. In addition, the internal frame 411 provides rigid support for axles (not shown) having rigidly mounted cogs (or cams) (also not shown) that are coupled to the motor 430, 530 by a chain 432, 532. Thus, the rotation of the motor causes the rotation of the axles. Alternative drive mechanisms may be employed to achieve the same action (motion) of the top supporting the patient/client.

In this embodiment more specifically, the motor 430, 530 is mechanically coupled to the lift system via the chain 432, 532 that runs from the motor 430, 530 to a first cog (cogs not shown) on a first axle (axles not shown) and a second cog on a second axle, such that the rotation of the first cog turns the first axle and the rotation of the second cog turns the second axle. Furthermore, the lift system is mechanically coupled to the first axle via a first lift disk 440, 540 and a second lift disk 541 such that the rotation of the first axle causes the rotation of the first lift disk 440, 540 and the second lift disk 541 (the lift disks are rotatably coupled to the internal frame axle support 513 by a lift disk mount 442.

Additionally, the lift system is mechanically coupled to the second axle via a third lift disk 542 and a fourth lift disk 543 such that the rotation of the second axle causes the rotation of the third lift disk 542 and the fourth lift disk 543. Thus, since the axles are also rigidly coupled to the lift disks 430, 530, 541, 542, 543 the rotation of the axles causes the articulation of the patient support system table 420 (thus, coupling the lift system to the power system).

The lift system, in the present embodiment of the impact table 400, includes a first lift receiver 422 disposed against the first lift disk 440, a second lift receiver (not shown) disposed against the second lift disk 541, a third lift receiver 423 disposed against the third lift disk 542, and a fourth lift receiver (not shown) disposed against the fourth lift disk 543. In the present embodiment, the first lift receiver 422, the second lift receiver, the third lift receiver 423 and the fourth lift receiver are rigidly coupled to the patient support system table 420. In an alternative preferred embodiment, a shock absorber is disposed between the patient support system table 420 and the support system lift receivers.

The control system includes a mechanically adjustable screw mechanism which, in the present embodiment of the impact table 400 includes a screw-support 450 and a threaded screw hole 413. The screw mechanism is coupled to the patient support system, and the mechanically adjustable screw mechanism is enabled to raise and lower the patient support system relative to the support system. This is achieved by turning the height adjustor 556, which protrudes through an access hole 554 in the power system support 534.

The mechanically adjustable screw mechanism evenly adjusts a plurality of screw-supports simultaneously because as the height adjustor 556 rotates, is pulls a chain 452, 552 that is coupled to a cog (not shown) on each of the screws 450, 451. The rotation of a screw causes the screw to travel up or down relative to the active frame 415, 515.

Accordingly, the up or down travel of the screw raises and lowers the patient support system table 420 relative to the active frame, and raises and lowers the patient support system table 420 relative to the lift disks 440, 540, 541, 542, 543, thus controlling the height or amplitude of an impact wave. Accordingly, the mechanically adjustable screw mechanism is coupled to a plurality of screw-supports, the screws being mechanically coupled to the support system and supportively coupled to the patient support system (as the support system preferably rests on the screws.

FIG. 5*b* illustrates an elevated side-view of an alternative embodiment of the invention. Notice that in this embodiment a frame 510 sits directly on a surface (not shown) via a plurality of feet 560, rather than being mounted to wheels, such as the wheel 412. Additionally, a lift control system 570 is manually operable to raise and lower the active frame 515. A lift receiver 522 mounted inside an impact table 520 is discussed in more detail in FIG. 10. Note that the impact table 520 is enabled to rest upon the active frame 515.

Figure 5C:
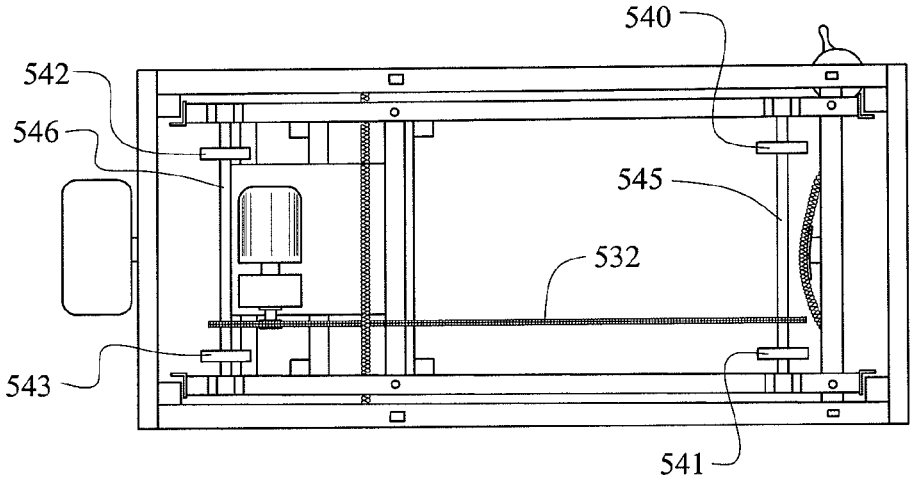
FIG. 5*c* is a top-down view of the alternative embodiment of FIG. 5*b;*

FIG. 5*c* is a top-down view of the alternative embodiment of FIG. 5*b*. From this view, one can see that the lift disks 540-543 are mounted upon axles 545, 546, as is more clearly shown and discussed in FIG. 9. In addition, the axles 545, 546 are shown being rotatably mounted into the inner frame 511. It is also clear from FIG. 5*c* that the chain 532 couples the motor 530 to the axles 545, 546.

Figure 5D:
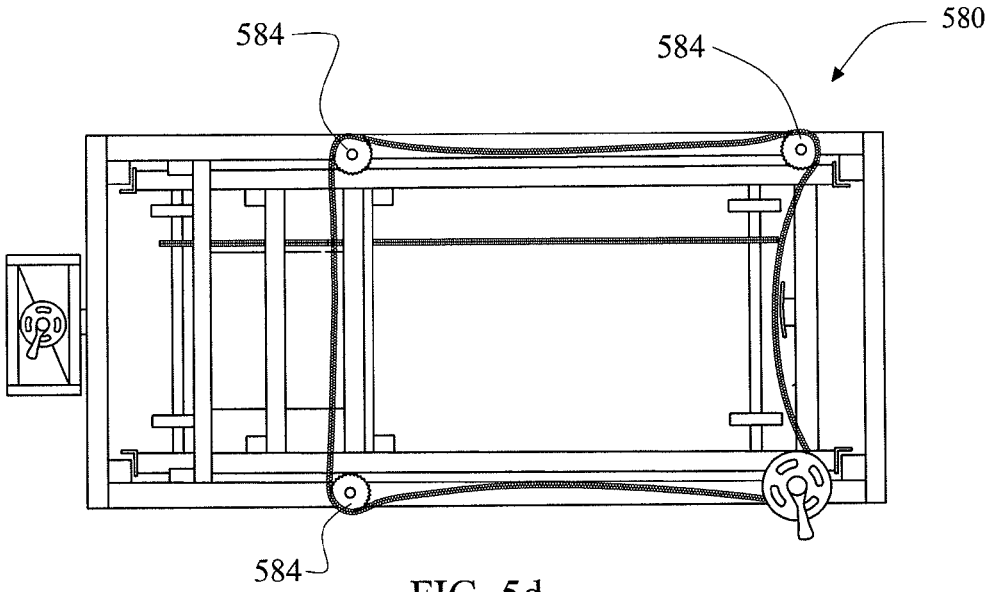
FIG. 5*d* is a bottom-up view of the alternative embodiment of FIG. 5*b;*

FIG. 5*d* is a bottom-up view of the alternative embodiment of FIG. 5*b*. This view shows a lift system 580 (which may be defined as a portion of the control system). The lift, system 580 includes a manual hand-crank 582 for turning a cog (not shown) attached to the manual hand crank 582. The chain 552 is coupled to the cog of the manual hand-crank 582, and is also attached to each of a plurality of cogs 584 that are each attached to a mechanically adjustable screw (not shown). Thus, in operation, a user can turn the manual hand-crank 582 to raise and lower the impact table 520.

Figure 5E:
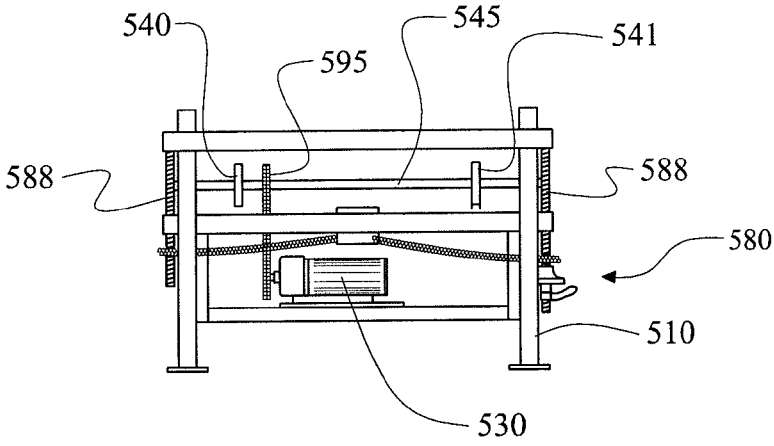
FIG. 5*e* is a rear-view of the alternative embodiment of FIG. 5*b* (headrest omitted)

FIG. 5*e* is a rear-view of the alternative embodiment of FIG. 5*b* (headrest and impact table are omitted). This view illustrates that the screws 588 of the lift system 580 may be located outside the frame 510. In addition, FIG. 5*e* shows one optional relationship between lift disks 540, 541, and axle 545, whereby one may see a cog 595 that couples the axle 454 to the motor 530.

Figure 6:
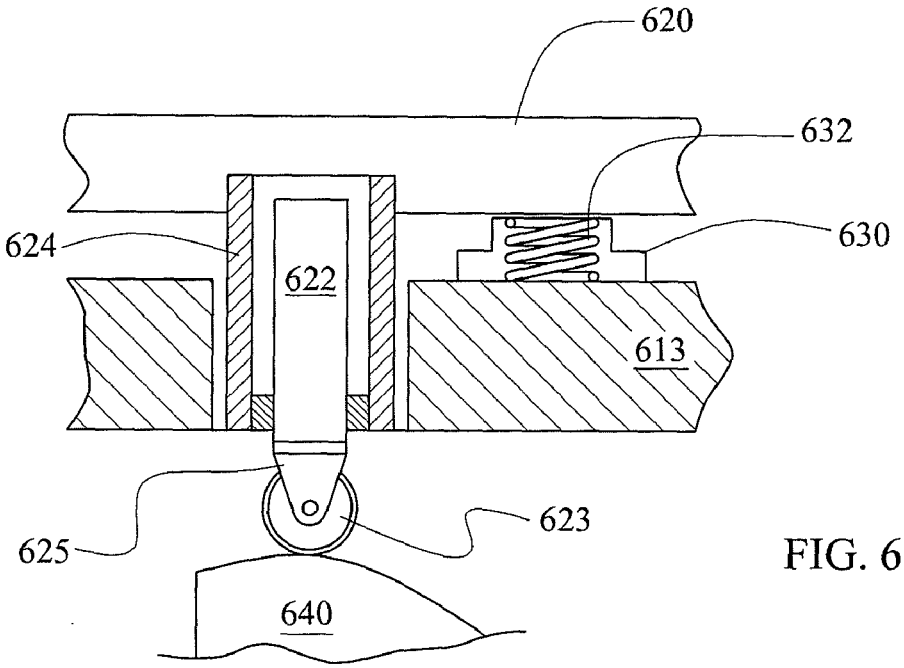
FIG. 6 shows a detailed view of a possible lift system for translating the lift of a cam to the tabletop by a pushrod and sleeve assembly.

FIG. 6 shows a detailed view of a lift system with an impact table-based shock absorber (the shock absorber) 630. The lift system includes a lift receiver. The lift receiver is generally defined by at least a pipe portion 622 that is mounted in a push-pipe 624 that is in turn rigidly coupled to the patient support system table 620, and a roller 623 coupled to the pipe portion 622 by a coupling portion 625 that is adapted to receive the roller 623. In operation, the roller 623 is disposed upon a lift disk 640. The table-based shock absorber 630 is disposed between the patient support system 620 and an active frame 613. However, it should be understood that the shock absorber (or any other shock absorbing device) may be located anywhere that a cushion effect is desired between the patient support system 620 and any other portion of the impact table. Alternatively, a single impact point could be utilized as in a horizontal lift/drop system. In a preferred embodiment, the shock absorber 630 includes a spring 632.

Figure 7:
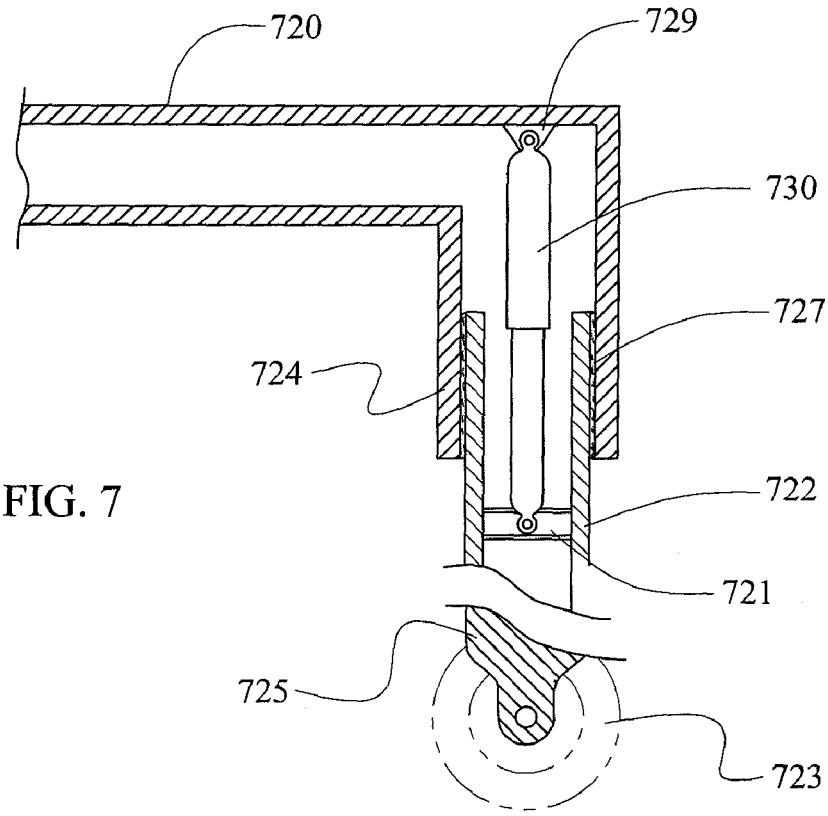
FIG. 7 shows a detailed view of a shock-absorbing feature within a telescoping leg support of the lift system.

FIG. 7 shows a detailed view of a lift system with a lift system based shock absorber 730. A lift receiver 722 includes a push-pipe 724 rigidly coupled to, and integrated with, the patient support system table 720. In the preferred embodiment, the push-pipe is embodied as a vertical pipe integrated with the patient support system table 720. The push-pipe 724 is for accepting the pipe portion of the lift-receiver 722. Preferably, the shock absorber 730 is rigidly coupled between the patient support system 720 and the lift receiver 722, and is mounted in an internal portion of the lift receiver 722, and in an internal portion of the patient support system 720. In one embodiment, the shock absorber 730 is coupled to the patient support system table 720 by an attachment lip 729 that is internally fixed to the patient support system. Similarly, the shock absorber 730 is internally mounted into the lift receiver 722 by a shock absorber coupling 721. The lift receiver 722 also includes a roller 723 coupled to the lift receiver 722 via a coupling portion 725 of the lift receiver 722. Furthermore, to reduce friction, a lubricating means 727, such as oil, padding, or Teflon™, for example, is disposed between the lift receiver 722 and the push-pipe 724.

Figure 8:
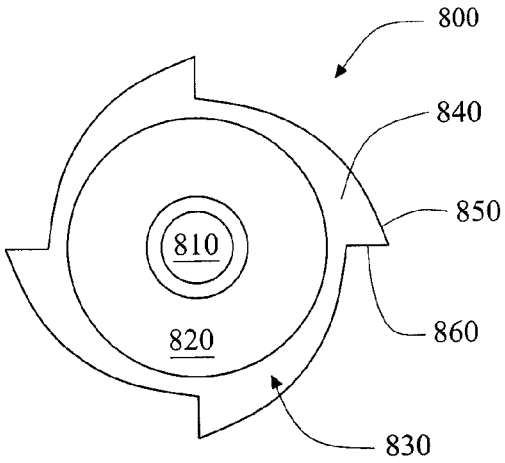
FIG. 8 provides a profile view of a lift disk.

FIG. 8 provides a profile view of a lift disk 800. The lift disk 800 includes a hole 810 through which an axle may be disposed and rigidly attached, a generally circular portion 820, and a shaped outer parameter 830. The outer parameter 830 is generally shaped to influence a predetermined amplitude and frequency (by providing a baseline for control system adjustments) in the impact table when the impact table is operating.

Accordingly, the outer parameter 830 includes at least one lift 840, where a lift comprises an inclined portion 850 and a radial portion 860. As one may suspect, the amplitude is influenced by a height of the radial portion 860, and the frequency is influenced by the number of lifts that are maintained on the radial portion of the lift disk 800. The amplitude and frequency may, of course, also be adjusted by a control system.

Figure 9:
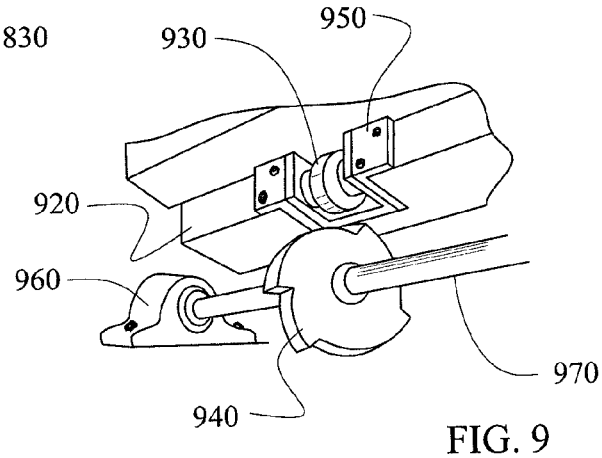
FIG. 9 shows a detailed view of a lift system being coupled to a lift disk.

FIG. 9 shows a detailed view of a lift system being coupled to a lift disk 940. The lift system includes a lift receiver. The lift receiver is generally defined by a roller 930 that is rotatably fixed in a mounting 950. The mounting 950 is in turn rigidly coupled to the patient support system table 920. The roller 930 is adapted to receive the lift disk 940.

An axle mount 960 is rigidly mounted to a frame (not shown), and the axle mount 960 rotatably supports a first axle 970. The first axle 970 has a rigidly mounted cog (or cam—not shown) that is coupled to a motor by a chain or other drive means. Thus, since a lift disk 940 is rigidly coupled to the first axle 970, the rotation of the motor causes the rotation of the axle 970, which in turn causes rotation of the lift disk 940.

Figure 10:
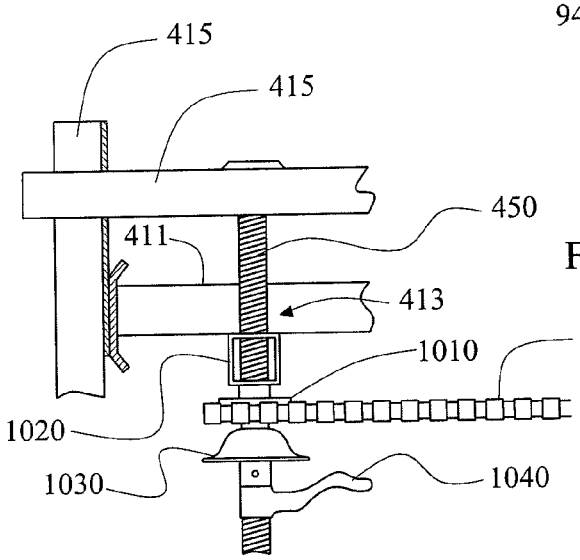
FIG. 10 shows one embodiment of an amplitude control system.

The amplitude of a shock wave can be influenced by adjusting the height of the patient support system table 420 relative to the height of the lift disk. FIG. 10 shows one embodiment of an amplitude control system 1000, which is usable with the impact table 400 of FIG. 4. The amplitude control system 1000 generally comprises a mechanically adjustable screw mechanism that is defined by a screw-support 450 and a threaded screw hole 413 in the interior frame 411.

The mechanically adjustable screw mechanism is enabled to raise and lower the patient support system relative to the lift disks. The mechanically adjustable screw mechanism evenly adjusts a plurality of screw-supports simultaneously to uniformly lift the patient support system. The simultaneous lift is achieved by rotating the height adjustor 556 that pulls a chain 452 that is coupled to each cog, such as a cog 1010 that is rigidly coupled to a screw—support, such as the screw-support 450. Preferably, a spacer 1020 separates the screw-support 450 from the cog 1010.

Thus, in operation, rotation of a screw 413 causes the screw-support 413 to travel up or down relative to the active frame 415. Accordingly, the up or down travel of the screw-support 450 raises and lowers the patient support system table 420, or, in other words, raises and lowers the patient support system table 420 relative to lift disks.

After adjusting the lift-support 450 to a desired height, then the lift-support 450 may be "locked" into place. To lock the lift-support 450 into place, a hand-twistable lift washer 1030 is rotated to fit snugly underneath the cog 1010, and a mechanical washer lock 1040 is locked into place underneath the lift washer 1030.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

I claim:

1. An impact table, comprising:

a table extending horizontally and configured for entirely supporting a patient lying on the table;

a plurality of rotatably mounted lift-disk means, each lift-disk means comprising a shaped outer perimeter, each shaped outer perimeter comprising at least one inclined portion and at least one radially extending surface, each lift-disk means in contact with a lift receiver, each lift receiver connected to the table;

wherein a power system is configured for simultaneously rotating the plurality of lift-disk means at a controllable rotation rate to provide a unitary motion of the table;

wherein during rotation at the rotation rate of the plurality of lift-disk means, the shaped outer perimeters of the lift-disk means lift and support the table when an inclined portion of each lift disk-means is in contact with each lift receiver, and wherein during rotation at the rotation rate of the plurality of lift-disk means, the shaped outer perimeters of the lift-disk means remove support from the table such that the table drops from a raised position to a low position when each lift receiver falls beside each radially extending surface, thereby allowing the entire table to drop in free-fall and induce a single, unified wave across the entire body of the patient lying on the table, such that the single, unified wave propagates away from the table and through the patient that is lying horizontally on the table; and shock absorbing means disposed between the table and the plurality of lift-disk means for absorbing a shock induced when the table reaches the low position, such that the shock is absorbed after the induction of said single, unified wave;

wherein the single, unified, wave operates to relax soft tissue strain patterns in the patient.

2. The impact table of claim 1 wherein allowing the table to drop induces wave in the table across an area approximately the size of the patient.

3. The impact table of claim 1, further including an amplitude control system configured to adjust a magnitude of a drop of the table when the plurality of rotatably mounted lift-disk means remove support from the table.

4. The impact table of claim 3, wherein the magnitude of the drop is less than one eighth of an inch (3.2 mm).

5. An impact table comprising:

a table extending horizontally and configured for entirely supporting a patient lying on the table;

a synchronous lift system comprising a plurality of rotatably mounted lift disks, each lift disk comprising a shaped outer perimeter, each shaped outer perimeter comprising at least one inclined portion and at least one radially extending surface;

a power system configured for rotating the plurality of lift disks at a controllable rotation rate; and a plurality of lift receivers connected to the table, each lift receiver comprising a roller, each roller being in contact with the shaped outer perimeter of a respective lift disk;

wherein during rotation at the rotation rate of the plurality of lift disks, the shaped outer perimeters of the lift disks lift and support the table when an inclined portion of each lift disk is in contact with each roller, and wherein during rotation at the rotation rate of the plurality of lift disks, the shaped outer perimeters of the lift disks remove support from the table when each of the rollers falls beside the radially extending surface of each lift disk, thereby allowing the entire table to drop in free-fall from a raised position to a low position and to induce a single, unified wave in the patient lying on the table; and means for absorbing a shock at the low position of said free-fall, the means for absorbing shock disposed between the table and the synchronous lift system so that said shock is absorbed after the induction of said single, unified wave;

wherein the single, unified wave operates to relax soft tissue strain patterns in the patient who is lying on the table.

6. The impact table of claim 5 further comprising:

a control system coupled to the power system to control a frequency of rotation of the plurality of lift disks.

7. The impact table of claim 5 wherein the power system comprises a motor.

8. The impact table of claim 7 wherein the motor is mechanically coupled to the lift system via a chain that runs from the motor to a first cog on a first axle and a second cog on a second axle, such that the rotation of the first cog turns the first axle and the rotation of the second cog turns the second axle.

9. The impact table of claim 8 wherein the lift system is mechanically coupled to the first axle via a first lift disk and a second lift disk such that the rotation of the first axle causes the rotation of the first lift disk and the second lift disk.

10. The impact table of claim 9 wherein the lift system is mechanically coupled to the second axle via a third lift disk and a fourth lift disk such that the rotation of the second axle causes the rotation of the third lift disk and the fourth lift disk.

11. The impact table of claim 10 wherein the lift system comprises:

a first lift receiver disposed against the first lift disk;

a second lift receiver disposed against the second lift disk;

a third lift receiver disposed against the third lift disk; and a fourth lift receiver disposed against the fourth lift disk.

12. The impact table of claim 11 wherein each of the first lift receiver, the second lift receiver, the third lift receiver and the fourth lift receiver are rigidly coupled to the table.

13. The impact table of claim 11, wherein the means for absorbing shock includes at least one shock absorber disposed between the table and the lift system.

14. The impact table of claim 11 wherein each of the first lift receiver, the second lift receiver, the third lift receiver and the fourth lift receiver are coupled to the table via the means for absorbing shock, and wherein the means for absorbing shock includes a shock absorber coupling.

15. The impact table of claim 5 further comprising:

an amplitude control system configured to adjust a magnitude of a drop of the table when the plurality of lift disks remove support from the table.

16. The impact table of claim 15 wherein the amplitude control system comprises:

a mechanically adjustable screw mechanism that evenly adjusts a plurality of screw-supports simultaneously.

17. The impact table of claim 1, wherein each lift receiver comprises:

a push-pipe rigidly coupled to the table, wherein the roller is coupled to the push-pipe via a coupling portion of the push-pipe.

18. The impact table of claim 1 further comprising:

a push-pipe rigidly coupled to the table, the table having a vertical pipe for accepting the push-pipe;

wherein the means for absorbing shock includes a shock absorber rigidly coupled between the table and the push-pipe, and wherein the roller is coupled to the push-pipe via a coupling portion of the push-pipe.

* * * * *